US011110490B2

(12) United States Patent
Koerner

(10) Patent No.: US 11,110,490 B2
(45) Date of Patent: Sep. 7, 2021

(54) MULTILEVEL SIEVE SYSTEM AND METHOD OF USE

(71) Applicant: Lloyd Harvey Koerner, Zillah, WA (US)

(72) Inventor: Lloyd Harvey Koerner, Zillah, WA (US)

( * ) Notice: Subject to any disclaimer, the term of this patent is extended or adjusted under 35 U.S.C. 154(b) by 282 days.

(21) Appl. No.: 16/281,139

(22) Filed: Feb. 21, 2019

(65) Prior Publication Data

US 2019/0255570 A1 Aug. 22, 2019

Related U.S. Application Data

(60) Provisional application No. 62/633,533, filed on Feb. 21, 2018.

(51) Int. Cl.
*B07B 1/02* (2006.01)

(52) U.S. Cl.
CPC ..... *B07B 1/02* (2013.01); *B07B 2201/04* (2013.01)

(58) Field of Classification Search
CPC ..... B07B 1/02
USPC ..... 209/311, 315, 420
See application file for complete search history.

(56) References Cited

U.S. PATENT DOCUMENTS

| | | | | |
|---|---|---|---|---|
| 3,315,807 | A * | 4/1967 | Rosen | A63H 33/32 209/315 |
| 5,538,139 | A * | 7/1996 | Keller | B07B 1/38 209/382 |
| 8,646,614 | B2 * | 2/2014 | Peterson | B03B 5/02 209/235 |
| 9,232,872 | B2 * | 1/2016 | Rivera | B65D 85/8043 |
| 2010/0071255 | A1 * | 3/2010 | Zilbershlag | A01M 1/026 43/107 |
| 2019/0343066 | A1 * | 11/2019 | Fan | A01K 1/0114 |

* cited by examiner

*Primary Examiner* — Terrell H Matthews
(74) *Attorney, Agent, or Firm* — Christopher Mayle; Bold IP, PLLC

(57) ABSTRACT

A system and method sort, separate, organize and store particles of different material, shape, and size utilizing a multi-level system of containers with sieves at different heights. The system employs a combination of gravitational downward forces on the individual pieces and omnidirectional manual forces applied by the user on the system to automatically sort and organize particles of different shape and size into the respective containers.

19 Claims, 11 Drawing Sheets

MULTILEVEL SIEVE SYSTEM AND METHOD OF USE

CROSS REFERENCE TO RELATED APPLICATION

This application claims priority to a prior-filed provisional application Ser. No. 62/633,533 filed on Feb. 21, 2018.

FIELD OF DISCLOSURE

The overall field of the disclosure relates in general to a system and method for organizing particulates and more particularly to a system and method for a multileveled device in the form of a hand operated sieve to separate and categorize different sized and shaped particulates.

BACKGROUND

The importance of particulate size separation and categorization by sieving cannot be understated. In various industries, different types of machinery and processes are used to produce specific materials. During this activity though, particulates of different size of materials are formed. Thus, graduation of these particulates according to their size or shape becomes necessary for calculation, distribution, and categorization. Sieving is also necessary to separate fine materials from more coarse materials so that the fine materials are not wasted when coarse materials are once again grinded or put through other machining processes. Current systems and methods for sieving either require electric or mechanical systems or are not constructed to efficiently separate particulates. Systems that require electrical or mechanical systems to sort and organize particulates can be expensive, lack portability, and do not operate if there isn't a sufficient enough power source to provide power to the system. They also have many deficiencies such as not being easily stackable, not being portable, and sometimes particulates even become attached to the walls or base and cannot filter through the apparatus. Thus exists a need for a system and method for a hand operated manual device to separate particulates of different shape and size that is portable, easy to store, and easy to clean, as well as accessible enough for anyone to use.

SUMMARY

In one aspect, the present invention is directed to a system for sieving different sized particulates, comprising, a plurality of stackable, sorting containers, configured to hold a quantity of a particulate, each sorting container comprising a sidewalls projecting upwardly and outwardly from a base, mesh connected to the base of the container, the mesh defining a plurality of holes, an opening at a top of the system provided to allow for particulates to be introduced into the system, and a bottom container comprising a bottom, the bottom configured to be devoid of openings so as to collect particulates that pass through the openings in the plurality of sorting containers above the bottom container, each container configured for sifting the particulates by moving the container in a reciprocating motion thereby allowing the particulates therein to pass through the holes, onto the base of the container below, while the higher container retains all particulates being larger than the openings.

In another aspect, the present invention is directed to a system for sieving different sized particulates, comprising: a plurality of containers, configured to hold a quantity of a particulate, each container comprising sidewalls projecting upwardly and outwardly from a base, a mesh, the mesh defining a plurality of holes, the base having a recess, the recess sized to receive the mesh, an outer area of the mesh equal to or slightly smaller to an inner area of the recess, an opening at a top of the system provided to allow for particulates to be introduced into the system, and a bottom container comprising a bottom, the bottom configured to be devoid of openings so as to collect particulates that pass through the openings in the plurality of sorting containers above the bottom container, each container configured for sifting the particulates by moving the container in a reciprocating motion thereby allowing the particulates therein to pass through the holes, onto the base of the container below, while the higher tray retains all particulates being larger than the openings, wherein the mesh and the recess are in frictional contact with one another, forming a seal to prevent the particulates from escaping unless through the plurality of openings down into the container below.

BRIEF DESCRIPTION OF DRAWINGS

The present invention will be described by way of exemplary embodiments, but not limitations, illustrated in the accompanying drawings in which like references denote similar elements, and in which.

DETAILED DESCRIPTION

Figure 1:
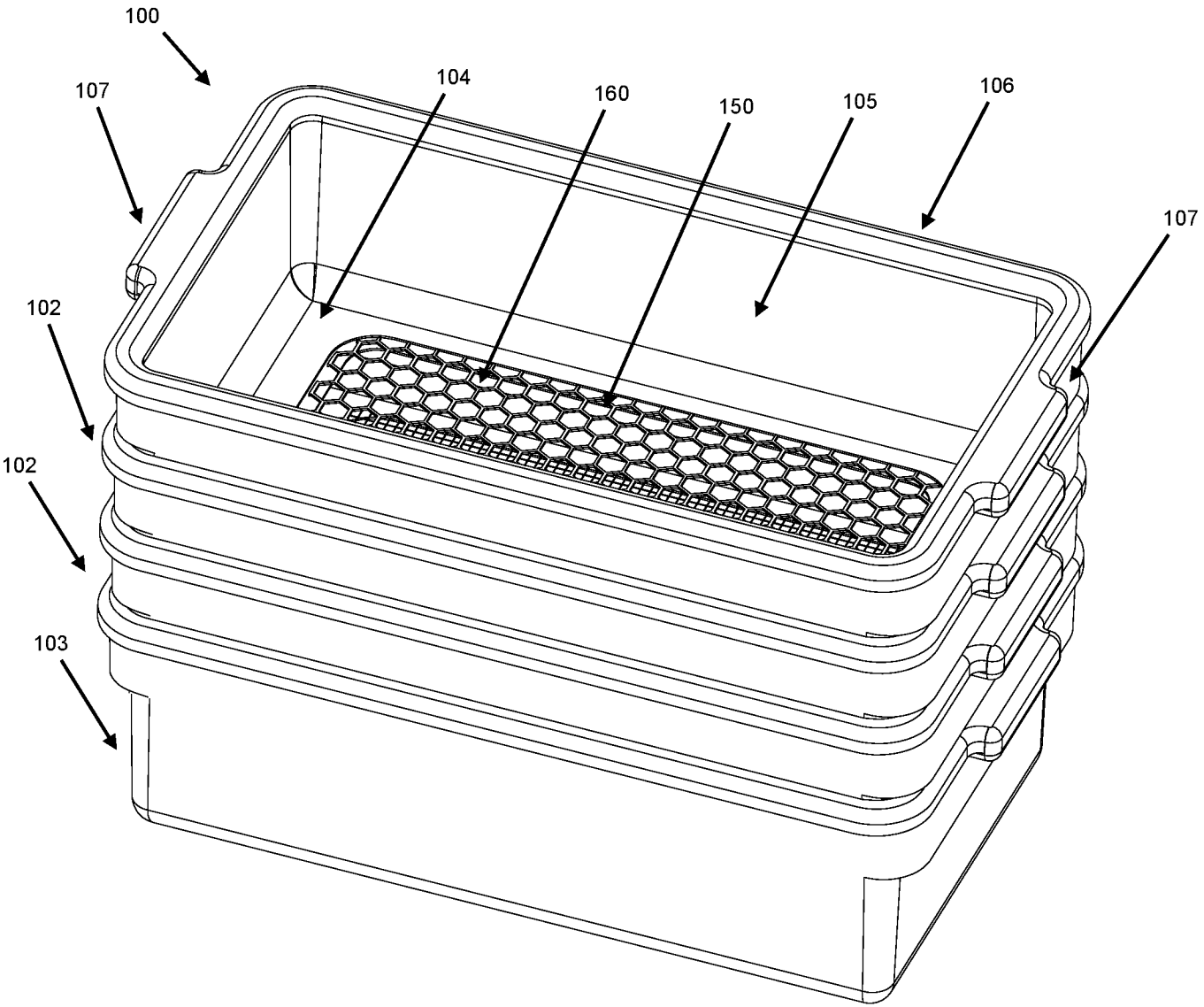
FIG. 1 depicts a perspective view of the multilevel sieve system in accordance with the present invention.

In the Summary above and in this Detailed Description, and the claims below, and in the accompanying drawings, reference is made to particular features of the invention. It is to be understood that the disclosure of the invention in this specification includes all possible combinations of such particular features. For example, where a particular feature is disclosed in the context of a particular aspect or embodiment of the invention, or a particular claim, that feature may also be used, to the extent possible, in combination with and/or in the context of other particular aspects and embodiments of the invention, and in the invention generally.

Where reference is made herein to a method comprising two or more defined steps, the defined steps may be carried out in any order or simultaneously (except where the context excludes that possibility), and the method may include one or more other steps which are carried out before any of the defined steps, between two of the defined steps, or after all the defined steps (except where the context excludes that possibility).

"Exemplary" is used herein to mean "serving as an example, instance, or illustration." Any aspect described in this document as "exemplary" is not necessarily to be construed as preferred or advantageous over other aspects.

Throughout the drawings, like reference characters are used to designate like elements. As used herein, the term "coupled" or "coupling" may indicate a connection. The connection may be a direct or an indirect connection between one or more items. Further, the term "set" as used herein may denote one or more of any item, so a "set of items," may indicate the presence of only one item, or may indicate more items. Thus, the term "set" may be equivalent to "one or more" as used herein.

The present disclosure recognizes the unsolved need for a system and method to sort, separate, organize, and store particulates of different material, shape, and size utilizing a multi-level system of containers with replaceable sieves at different elevation levels. The system employs a combination of gravitational downward forces on the individual pieces and omnidirectional manual forces applied by an operator on the system to automatically sort and organize particulates of different shape and size into the respective containers. Each container and the container's sieves are constructed so that particular sizes and shapes may be filtered downward to the next level, resulting finally in a set of sorted particulates at different levels within the system. The containers also function as storage structures for the particulates before, during, and after the sorting of the particulates whereby they may also be easily transported and moved into other apparatuses.

With reference now to FIG. 1, one exemplary embodiment of multi-layered sieving system 100 is illustrated including containers such as containers 102 and meshes such as meshes 150, 152, and 154 and a bottom container such as bottom container 103. Containers 102 and 103 include a base such as bases 104 and sidewalls such as sidewalls 105 projecting upwardly and outwardly from bases 104 of containers 102 and 103 until forming an opening. The opening may be square, rectangular, circular, oval, triangle, trapezoid, octagon, or hexagon in shape. Sidewalls 105 may include a slight draft angle, thereby aiding the nesting and separation of the plurality of containers 102 and 103. The draft angle may be of any degrees from a minimum of 1 degree or higher while in other embodiments the sidewalls may be completely vertical. The draft angles of the sidewalls are chosen, in part, to promote tight nesting, as well as facilitate the release of individual containers 102 from a nested stack.

Figure 2:
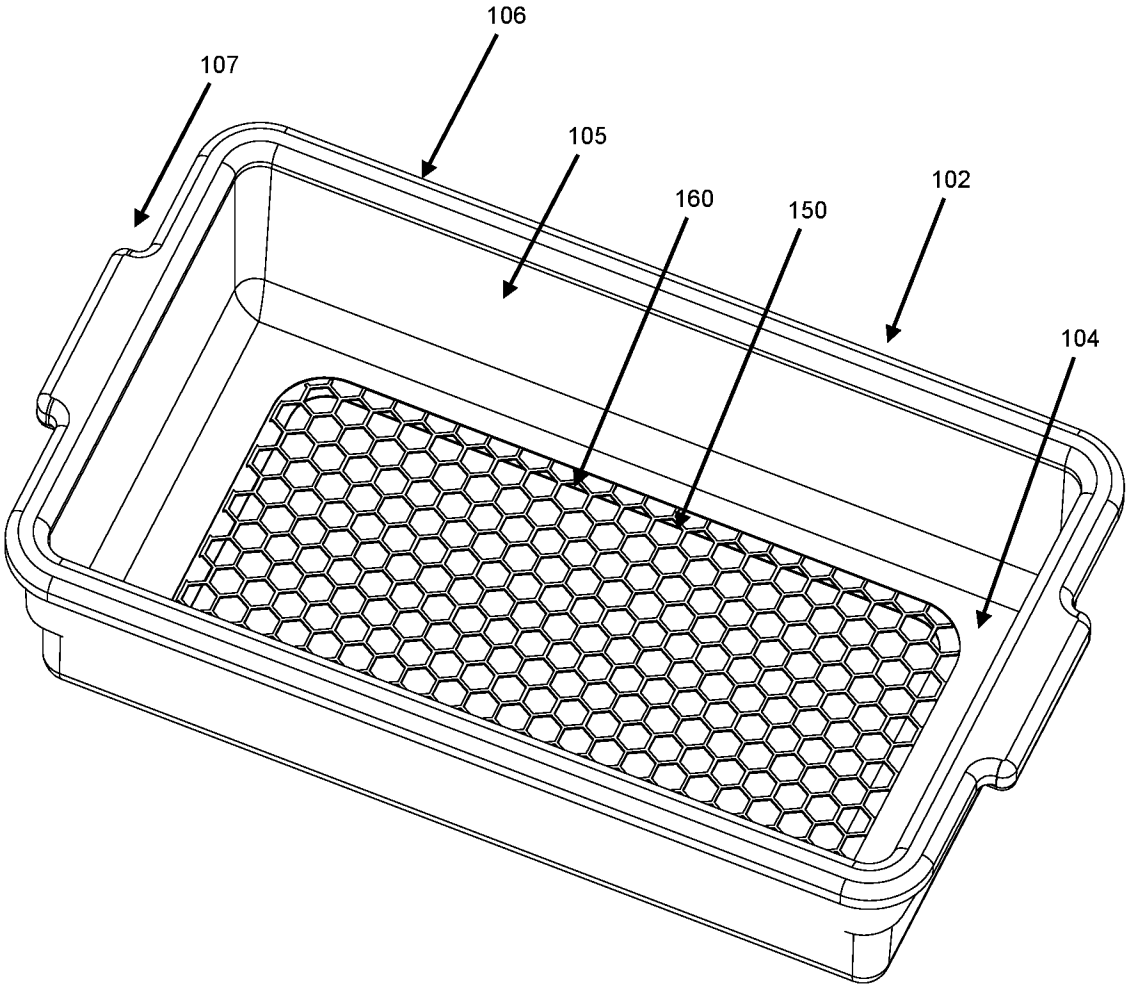
FIG. 2 depicts a perspective view of a container of the multilevel sieve system.
Figure 3:
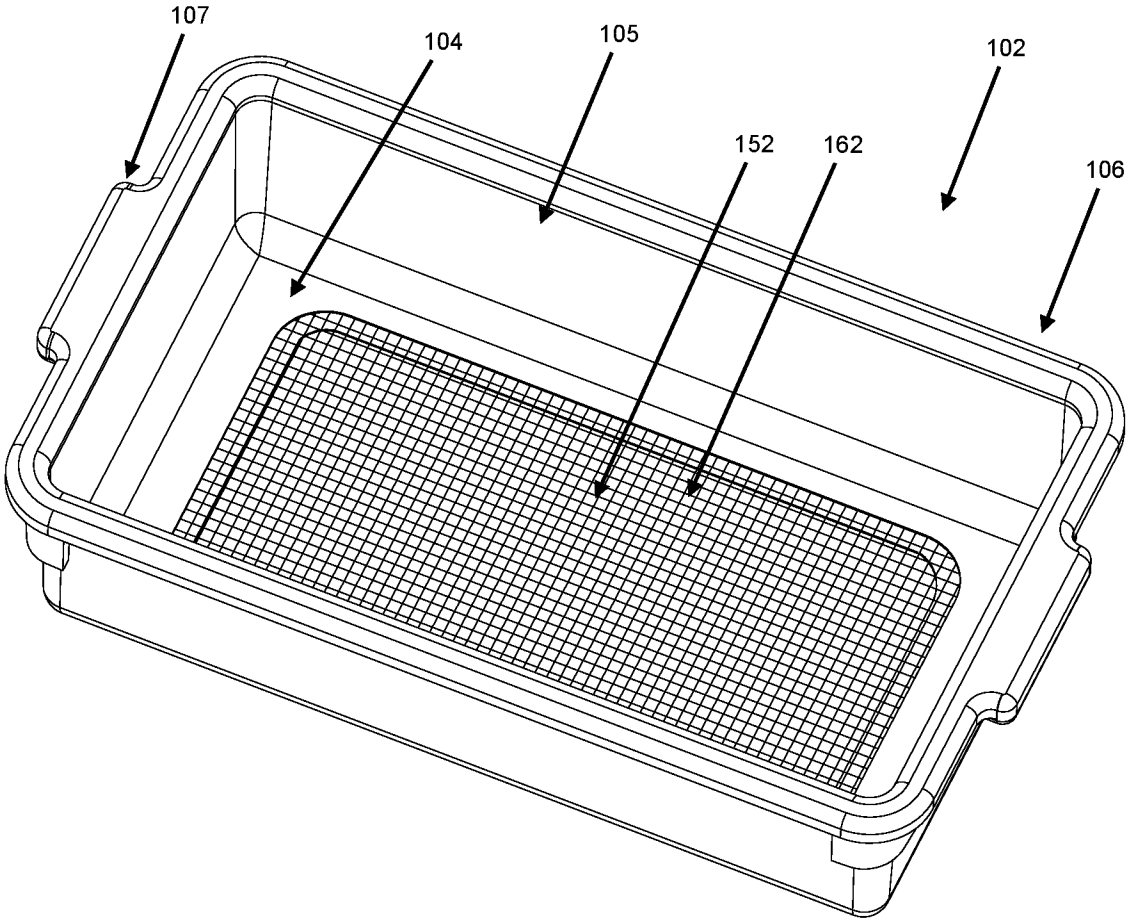
FIG. 3 depicts a perspective view of a second container of the multilevel sieve system.
Figure 4:
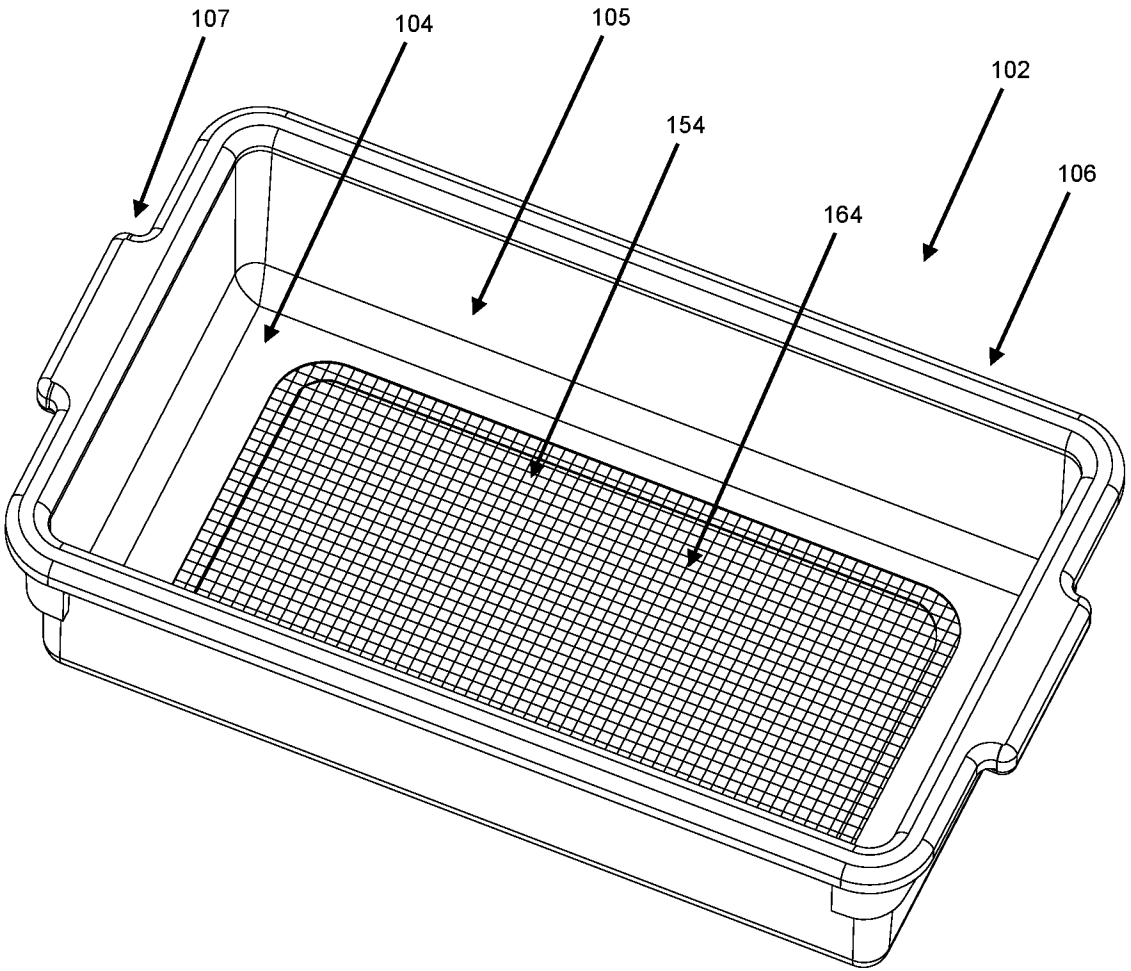
FIG. 4 depicts a perspective view of a third container of the multilevel sieve system.
Figure 5:
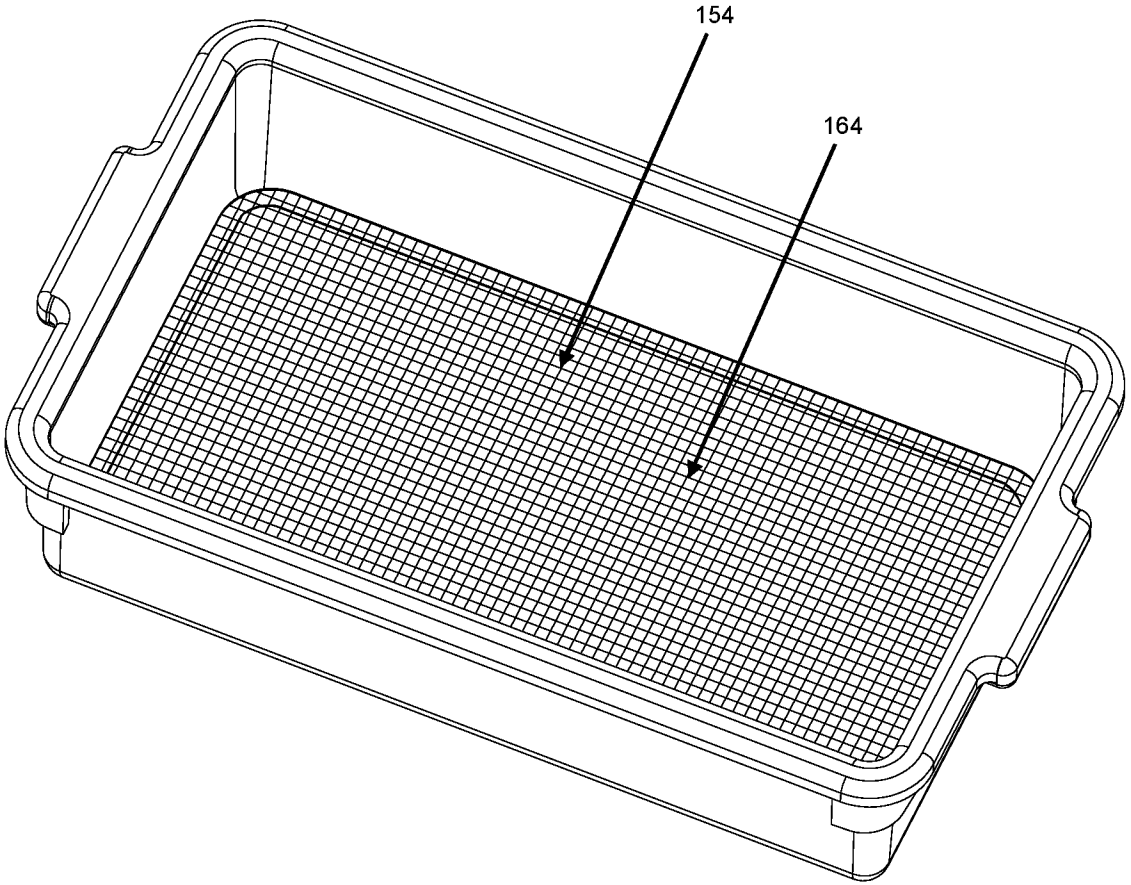
FIG. 5 depicts a perspective view of a container of another embodiment of the multilevel sieve system.
Figure 6A:
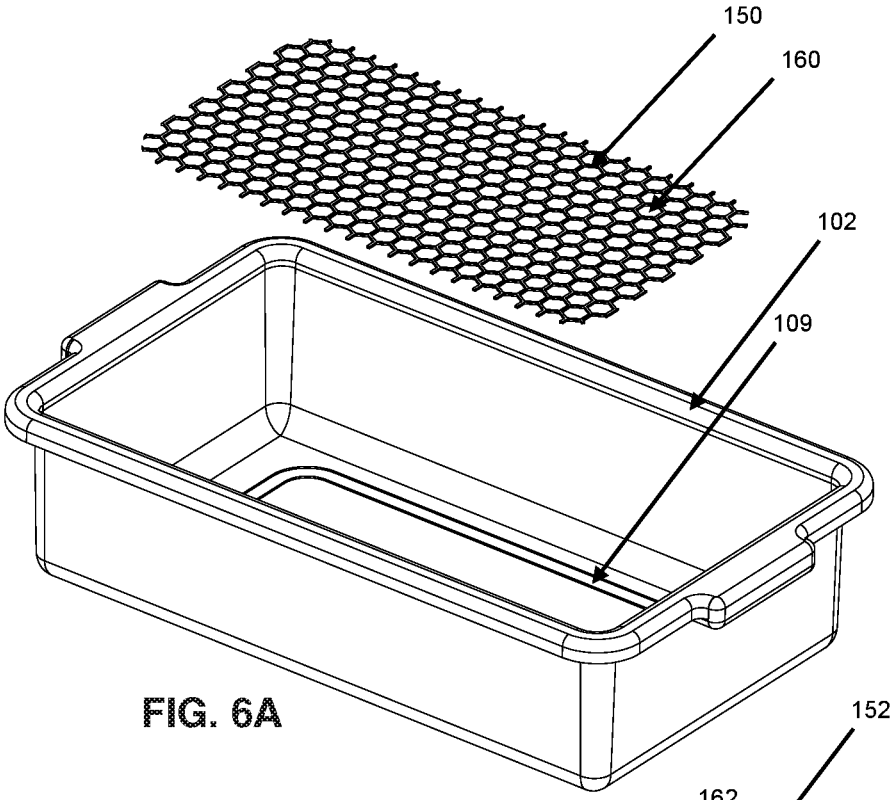
FIGS. 6 A-D depict the meshes and recesses of the multilevel sieve system.
Figure 6B:
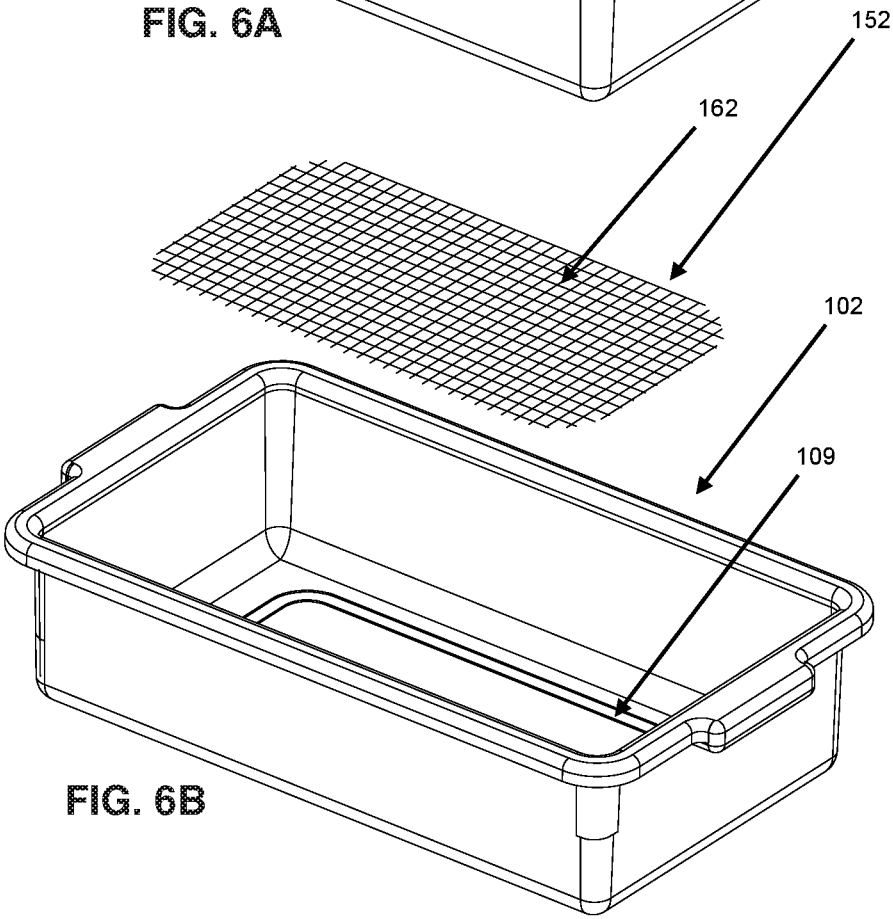
Figure 6C:
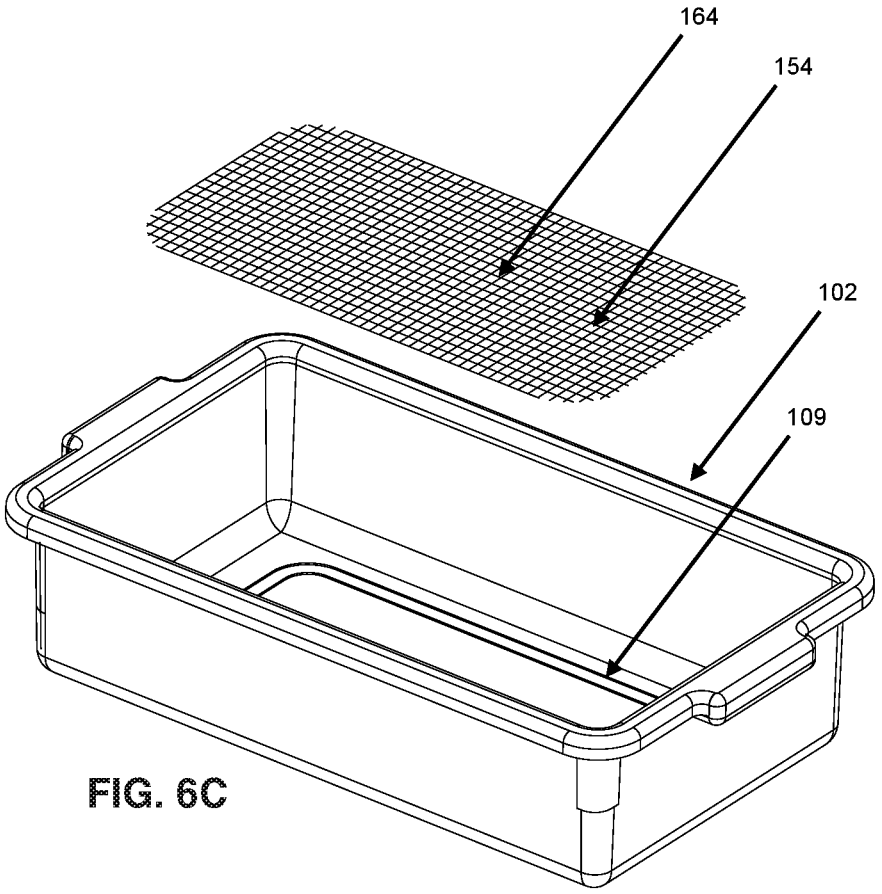
Figure 6D:
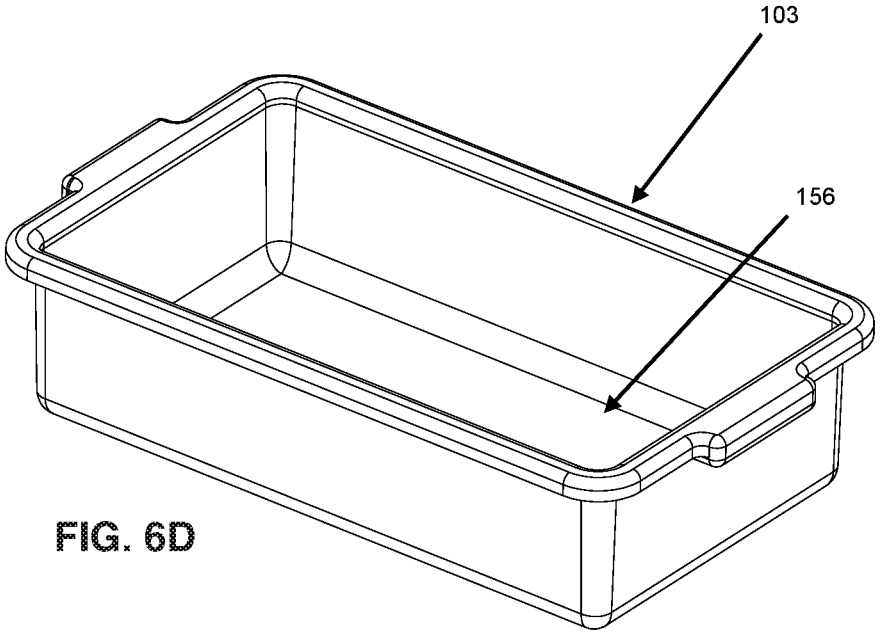

Mesh 150, 152, and 154 may have a plurality of holes such as holes 160, 162, and 164 as shown in FIGS. 2, 3, 4 and be made of a metal such as stainless steel. Other metals may be used such as aluminum, gold, plastic, fiber, tin, or other materials that yield the desired mesh size and mechanical strength. Holes 160 are shown as hexagonal in shape while holes 162 and 164 are in square in shape. These shapes and arrangements were selected to improve the speed and ease in filtering particulates through system 100. However, the shapes may include: all of, a mixture of, or any manner of derivation of, rectangular, square, circular, oval, trapezoidal, triangular shapes, arranged in all manner of patterns. In further embodiments as illustrated in FIG. 5, mesh 150, 152, and 154 may completely take up the entire base portion of containers 102.

In one or more non-limiting embodiments a supporting flange perimeter such as flange perimeter 106 may be located at the opening of each container 102 and bottom container 103. Perimeter flanges 106 may be connected to strategically positioned integrated handholds such as handhelds 107 to help with gripping of containers 102 and 103. Perimeter flanges 106 and handles 107 provide shape-supporting rigidity to the top of containers 102 and 103 and may be used as a handholding apparatus during sieving such that an operator may provide a reciprocating motion. Containers 102 and 103 are preferably made of a transparent polymer-plastic that may be injection or compression molded allowing for an operator to view the separation of particulates and determine whether any particulates are stuck in container 102 and 103 or have been thoroughly distributed. This, however, is non limiting and any other materials such as metal, wood, cardboard, fiberglass, and glass may be used that may provide the necessary function of filtering particulates through the system.

Bases 104 of the containers 102 may have a recess such as recess 109 as illustrated in FIGS. 6A-6D. Recesses 109 may be sized to permit meshes 150, 152, and 154 to be attached to recess 109 of base 104 of each container 102 whereby mesh 150, 152, and 154 may completely cover the opening in base 104 of each container 102 to prevent the passage of substantially larger particulates from passing through base 104. Recesses 109 may have a supporting recess land for mesh 150, 152, and 154 to rest upon or near when mesh 150, 152, and 154 is attached to recess 109. The outer area of mesh 150, 152, and 154 is either equal or slightly smaller to an inner area of recess 109. This engagement applies a force inward from recess to outer area of mesh 150, 152, and 154 to form a static and dynamic seal that prevent particulates from escaping around mesh 150, 152, and 154 down into the next container 102 and 103. Mesh 150, 152, and 154 do not move relative to recess 109 unless an external force is applied to mesh 150, 152, and 154 (e.g. such as by grabbing a part of mesh 150, 152, and 154 and applying an upwards directional force or if a container 102 is upside down, applying a downward force on mesh 150, 152, and 154. In one or more non-limiting embodiments, mesh 150, 152, and 154 may be attached to a recess on the bottom surface of container 102 or bottom surface of base 104 of containers 102.

A variety of different type of mesh 150, 152, and 154 may be used. Mesh 150, 152, and 154 are designed to be quickly installed and removed. Mesh 150, 152, and 154 may be selected and positioned to fit the individual use and needs of the operator. In further embodiments, openings 160, 162, and 164 may be a series of slots in parallel or other formation. In other non-limiting embodiments, mesh 150, 152, and 154 may be affixed to base 104 of the containers with, for example, fasteners, adhesive, latches, hinges, welding techniques, or any other method known to those skilled in the art wherein smaller particulates that fit through mesh 150, 152, and 154 will not be trapped in containers 102.

Containers 102 and bottom container 103 may be stacked on top of each other in a nesting stack configuration. The size of the holes in mesh 150, 152, and 154 in containers 102 are sized and shaped to allow only certain sized particulates to pass through while retaining larger sizes in the container until the smallest sized particulates are collected at the bottom. For example the mesh attached to the base of the container at the highest vertical level has the biggest holes while the mesh attached to the base of the container directly below it has smaller holes than the mesh above it. This is continued until bottom container 103 whereby bottom container 103 has a bottom 156 that is without an opening so as to collect the smallest particulates. Holes 160, 162, and 164 may be of any size and may be of any size distribution to meet customized needs of different particulates and materials. In one or more non-limiting embodiments, holes 160, 162, and 164 in the mesh of the containers may be aligned while in other embodiments holes 160, 162, and 164 in mesh 150, 152, and 154 with respect to each container 102 may be offset from one another. In one or more non-limiting embodiments the bottom container may have wheels attached to it for improving portability while also enhancing the sorting of particulates by capitalizing on the different forces applied from rolling the container.

Figure 7:
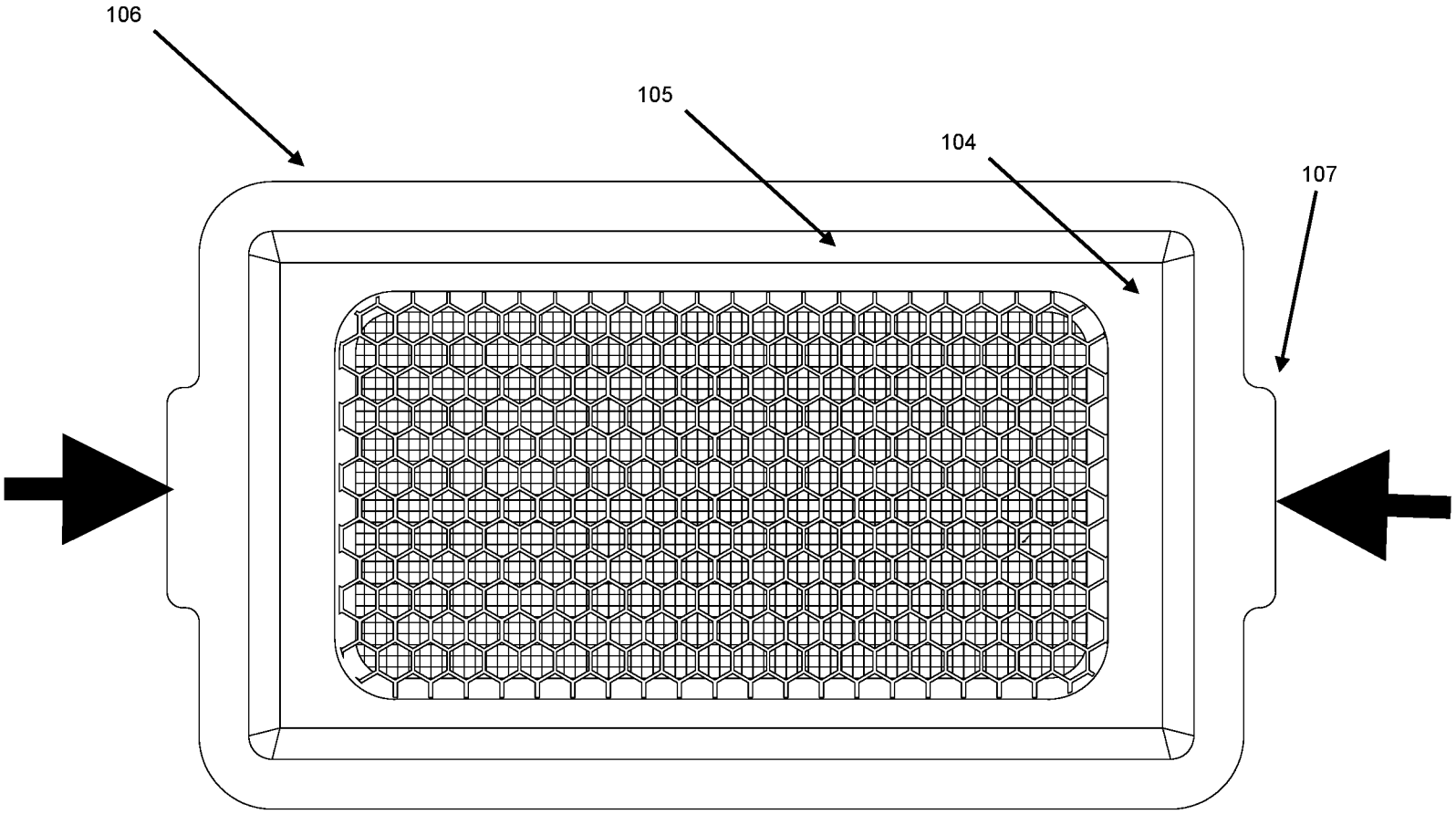
FIG. 7 depicts a top view of the multilevel sieve system.
Figure 8:
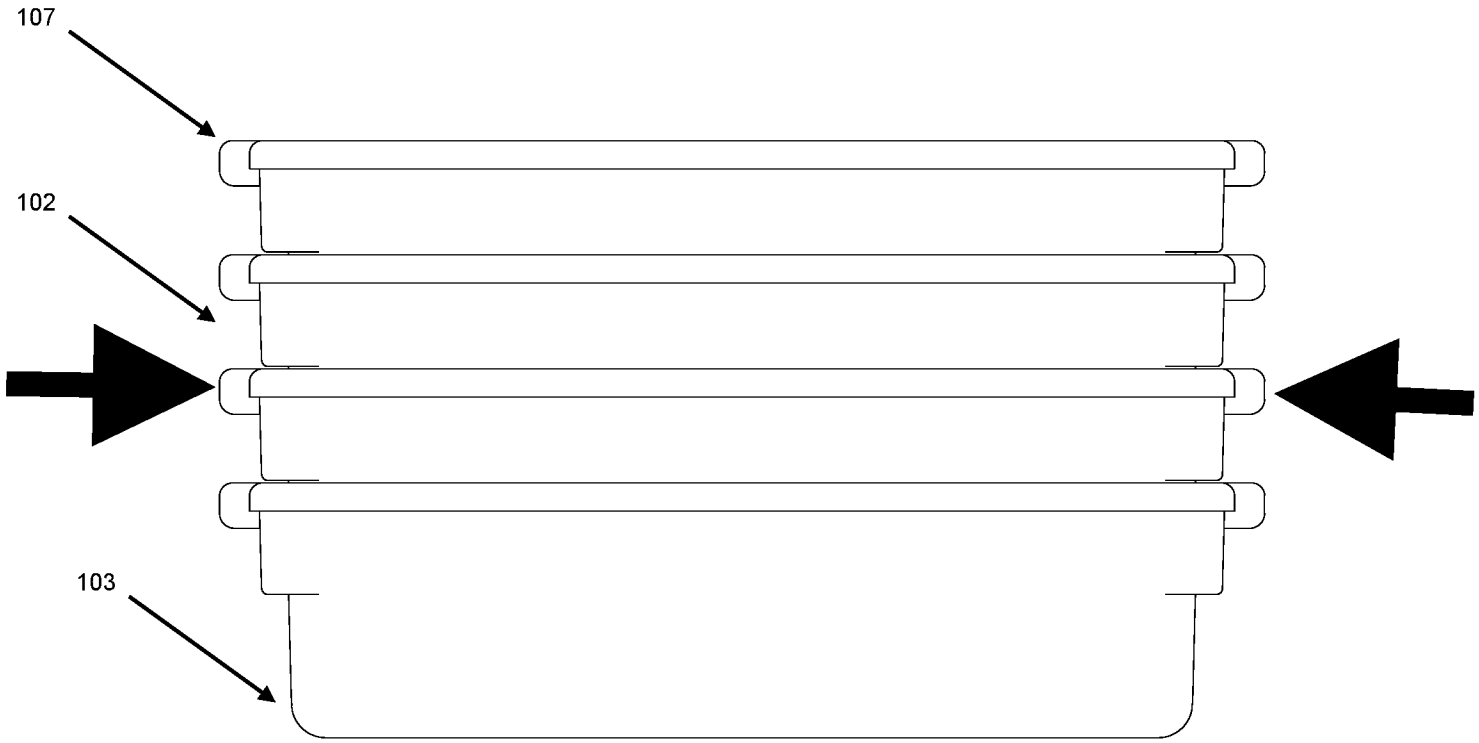
FIG. 8 depicts a side view of the multilevel sieve system.

The sieving process is carried out by inserting particulates in the highest container and through a manual force of rolling, shaking, pulling, or twisting the stack of nested containers as illustrated in FIGS. 7 and 8, which forces particulates in each container to move towards the mesh at the base of each container and cause certain particulates to fall through meshes enabling the sorting of the different sized particulates. As the system undergoes more shakes, pulls, rolls, and twists, more particulates are sorted until eventually all pieces are sorted into the appropriate containers. The smallest particulates fall or drop into the bottom container while the largest particulates are retained in the highest container. The other containers contain particulates of specific size ranges depending on the size of the mesh. For example, in the illustrated embodiment the highest container 102 may have mesh 150 at base 104 such that when particulates are placed in container 102 and system 100 is moved in a reciprocating motion, particulates smaller than holes 160 pass through mesh 150 into container 102 having mesh 152 at base 104 while particulates larger than holes 160 stay in container 102 having mesh 150.

The same process happens again as system 100 is moved in a reciprocating motion whereby particulates smaller than holes 162 pass through mesh 152 into container 102 having mesh 154 while particulate larger than holes 162 stay in the container having mesh 152. Finally, as system 100 is moved in a reciprocating motion, particulates smaller than holes 164 pass through mesh 154 into bottom 156 of bottom container 103 while particulates larger than holes 164. stay in container 102 having mesh 154. With removable mesh it may be appreciated that any number of combinations and arrangements may be used for system 100 such as removing a container and mesh where particulates are only separated 2 times or rearranged so that multiple sizes of particulates may be collected in a container.

In one or more non-limiting embodiments the top most container 102 may have a lid, sealing container 102 shut and preventing the particulates from escaping. The lid may have a substantially rectangular body having a slightly greater area than container 102 opening allowing for centering the lid over the opening in container 102 and thereafter engaging the lid to secure the lid in place on top of container 102. This engagement applies a force inward from the lid to the outer surface of container 102 and against the inside surface of container 102 to create a substantially tight seal that prevents the exiting of particulates from container 102. The lid may be removed by applying a force greater than the force such as a user pulling on the handle away from container 102.

Figure 9:
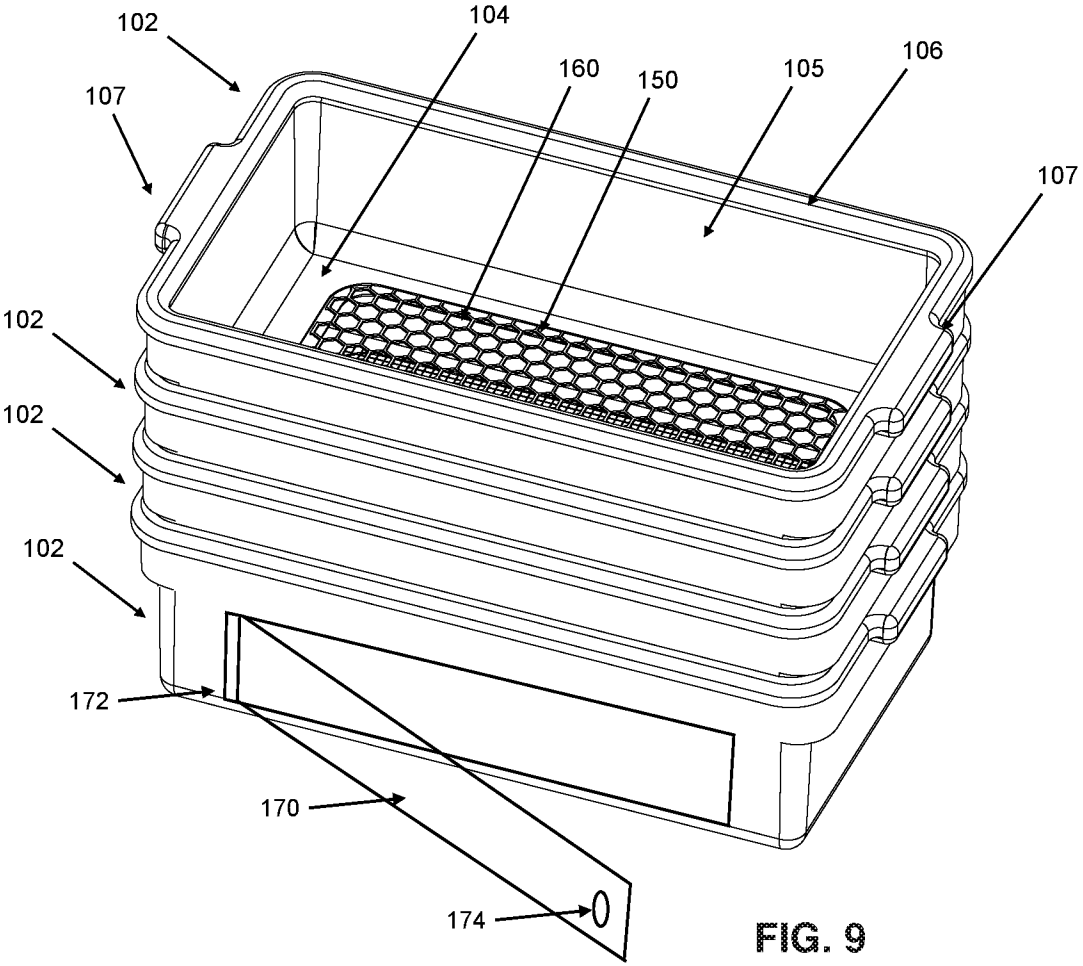
FIG. 9 depicts a perspective view of another embodiment of the multilevel sieve system.
Figure 10:
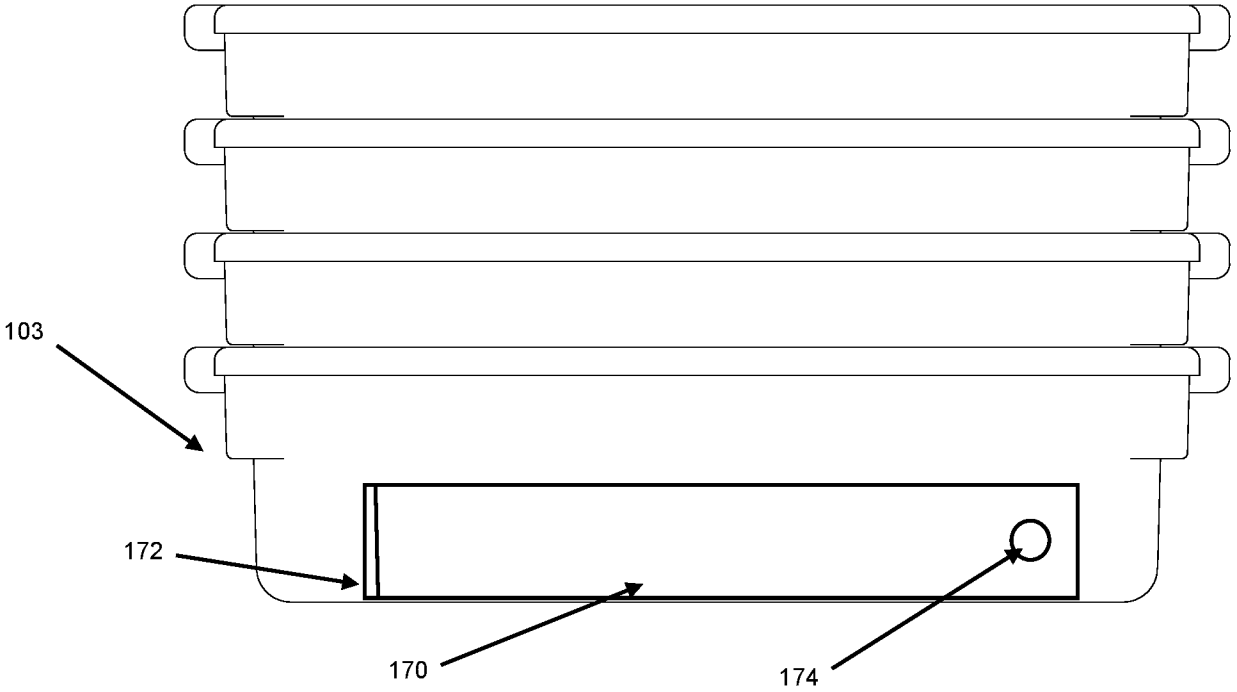
FIG. 10 depicts a side view of the embodiment depicted in FIG. 7.

In one or more non-limiting embodiments, bottom container 103 may have a drawer-removal door such as door 170, as illustrated in FIGS. 9 and 10, which allows access to the interior space of bottom container 103 whereby the operator may access the particulates in bottom container 103 directly from base 104 or bottom container 103. Door 170 may be rotatable in a horizontal direction as between a closed position wherein the door extends horizontally to seal bottom container 103 and an open position wherein door 170 extends outward so as to provide free access to the interior of bottom container 103 whereby fine particulates accumulated in bottom container 103 may be collected without disturbing the particulates in other containers 102 or removing containers 102 from the stacking nest. Door 170 may be connected to bottom container 103 by one or more hinges such as hinge 172, hinge 172 permitting rotational movement of door 170 relative to bottom container 103. Door 170 may have a projection such as handle 174, or a knob or other latch for an operator to grab to open door 170. Handle 174 may be connected to a spindle latch mechanism installed in sidewall 105 of container 103 allowing door 170 to stay closed. In further embodiments, there may be a drawer that is slidably supported inside container 103 and may be removed whereby fine particulates accumulated in bottom container 103 may be collected without disturbing the particulates in other containers 102 or removing containers 102 from the stacking nest. The drawer may be connected to side mounted rails on sidewalls 105 of container 103.

The foregoing description of the invention has been presented for purposes of illustration and description and is not intended to be exhaustive or to limit the invention to the precise form disclosed. Many modifications and variations are possible in light of the above teaching. The embodiments were chosen and described to best explain the principles of the invention and its practical application to thereby enable others skilled in the art to best use the invention in various embodiments and with various modifications suited to the use contemplated. The scope of the invention is to be defined by the above claims.

What is claimed is:

1. A system for sieving different sized particulates, comprising:

a plurality of containers, configured to hold a quantity of a particulate, each sorting container comprising sidewalls projecting upwardly and outwardly from a base, a mesh connected to the base of the container, the mesh defining a plurality of holes, each of the plurality of containers having a recessed surface lower than a top surface of the base wherein the mesh rests on the recessed surface such that the mesh is parallel with the top surface of the base;

an opening on top of the system provided to allow for particulates to be introduced into the system; and a bottom container comprising a bottom, the bottom devoid of openings so as to collect particulates that pass through the openings in the plurality of sorting containers above the bottom container;

wherein each container configured for sifting the particulates by moving the container in a reciprocating motion thereby allowing the particulates therein to pass through the mesh onto the base of the container below while the higher container retains particulates being larger than the openings.

2. The system of claim 1, wherein the containers are nested on top of another to form a vertically stacked array.

3. The system of claim 1, wherein the containers are made of a transparent material.

4. The system of claim 3, wherein the transparent material is polymer-plastic that may be injection or compression molded.

5. The system of claim 1, further comprising a perimeter flange flared laterally outward from said sidewalls to facilitate gripping, the perimeter flange configured to connect with one or more handles.

6. The system of claim 1, where in the holes are uniformly spaced over the mesh.

7. The system of claim 6, wherein the holes are arranged symmetrically in each container with respect to the openings in other containers when the containers are in a vertically stacked array.

8. The system of claim 7, wherein the holes are circular forming a grid uniformly spaced over the base.

9. The system of claim 1, wherein the sidewalls include a slight draft angle of at least 1 degree.

10. The system of claim 1, wherein the mesh is held in the recessed surface by frictional force and is removable, the mesh removable by applying an upward force greater than the frictional force.

11. A system for sieving different sized particulates, comprising:

a plurality of containers, configured to hold a quantity of a particulate, each container comprising sidewalls projecting upwardly and outwardly from a base, a mesh, the mesh defining a plurality of holes, the base having a recess, the recess sized to receive the mesh, an outer area of the mesh equal to or slightly smaller to an inner area of the recess;

an opening at a top of the system provided to allow for particulates to be introduced into the system;

and a bottom container comprising a bottom, the bottom configured to be devoid of openings so as to collect particulates that pass through the openings in the plurality of sorting containers above the bottom container, the bottom container having a doorway allowing access to the interior space of the bottom container;

each container configured for sifting the particulates by moving the container in a reciprocating motion thereby allowing the particulates therein to pass through the holes, onto the base of the container below, while the higher container retains particulates being larger than the openings;

wherein the mesh and the recess are in frictional contact with one another, forming a seal to prevent the particulates from escaping unless through the plurality of openings down into the container below.

12. The system of claim 11, wherein the mesh of each container is configured to be removed from the recess of each container by the application of an upwards directional force.

13. The system of claim 11, wherein the containers are nested on top of another to form a vertically stacked array.

14. The system of claim 11, wherein the containers are made of a transparent material.

15. The system of claim 14, wherein the transparent material is polymer-plastic that may be injection or compression molded.

16. The system of claim 11, further comprising a perimeter flange flared laterally outward from the sidewalls to facilitate gripping, the perimeter flange configured to connect with one or more handles.

17. The system of claim 11, further comprising a drawer slidably supported inside the bottom container.

18. The system of claim 11, wherein the containers are made of metal.

19. A system for sieving different sized particulates, comprising:

a plurality of containers, configured to hold a quantity of a particulate, each container comprising sidewalls projecting upwardly and outwardly from a base, a mesh, the mesh defining a plurality of holes, the base having a recess, the recess sized to receive the mesh, an outer area of the mesh equal to or slightly smaller to an inner area of the recess;

an opening at a top of the system provided to allow for particulates to be introduced into the system; and a bottom container comprising a bottom, the bottom configured to be devoid of openings so as to collect particulates that pass through the openings in the plurality of sorting containers above the bottom container, wherein a drawer is slidably supported inside the bottom container;

each container configured for sifting the particulates by moving the container in a reciprocating motion thereby allowing the particulates therein to pass through the holes, onto the base of the container below, while the higher container retains particulates being larger than the openings;

wherein the mesh and the recess are in frictional contact with one another, forming a seal to prevent the particulates from escaping unless through the plurality of openings down into the container below.

* * * * *